US010316685B2

(12) United States Patent
Davis et al.

(10) Patent No.: US 10,316,685 B2
(45) Date of Patent: Jun. 11, 2019

(54) GAS TURBINE ENGINE RAMPED RAPID RESPONSE CLEARANCE CONTROL SYSTEM

(71) Applicant: United Technologies Corporation, Farmington, CT (US)

(72) Inventors: Timothy M. Davis, Kennebunk, ME (US); Brian Duguay, Berwick, ME (US)

(73) Assignee: United Technologies Corporation, Farmington, CT (US)

( * ) Notice: Subject to any disclaimer, the term of this patent is extended or adjusted under 35 U.S.C. 154(b) by 419 days.

(21) Appl. No.: 15/024,686

(22) PCT Filed: Aug. 1, 2014

(86) PCT No.: PCT/US2014/049390

§ 371 (c)(1),
(2) Date: Mar. 24, 2016

(87) PCT Pub. No.: WO2015/050628

PCT Pub. Date: Apr. 9, 2015

(65) Prior Publication Data

US 2016/0265380 A1 Sep. 15, 2016

Related U.S. Application Data

(60) Provisional application No. 61/887,002, filed on Oct. 4, 2013.

(51) Int. Cl.
*F01D 11/22* (2006.01)

(52) U.S. Cl.
CPC ..... *F01D 11/22* (2013.01)

(58) Field of Classification Search
CPC ..... F01D 11/20; F01D 11/22
See application file for complete search history.

(56) References Cited

U.S. PATENT DOCUMENTS

| | | | | |
|---|---|---|---|---|
| 4,127,357 | A | 11/1978 | Patterson | |
| 4,714,404 | A * | 12/1987 | Lardellier | F01D 11/22 15/171 |
| 5,018,942 | A | 5/1991 | Ciokajlo et al. | |
| 5,035,573 | A | 7/1991 | Tseng et al. | |
| 5,049,033 | A | 9/1991 | Corsmeier et al. | |
| 5,054,997 | A | 10/1991 | Corsmeier et al. | |
| 5,056,988 | A * | 10/1991 | Corsmeier | F01D 11/22 415/126 |

(Continued)

FOREIGN PATENT DOCUMENTS

| | | |
|---|---|---|
| GB | 2068470 | 8/1981 |

OTHER PUBLICATIONS

Extended EP Search Report dated Oct. 14, 2016.

*Primary Examiner* — William M McCalister
(74) *Attorney, Agent, or Firm* — O'Shea Getz P.C.

(57) ABSTRACT

An active clearance control system of a gas turbine engine includes a multiple of blade outer air seal assemblies and a multiple of rotary ramps. Each of the multiple of rotary ramps is associated with one of the multiple of blade outer air seal assemblies. A method of active blade tip clearance control for a gas turbine engine is provided. The method includes rotating a multiple of rotary ramps to control a continuously adjustable radial position for each of a respective multiple of blade outer air seal assemblies.

12 Claims, 6 Drawing Sheets

(56) References Cited

U.S. PATENT DOCUMENTS

| | | | | |
|---|---|---|---|---|
| 5,228,828 | A | 7/1993 | Damlis et al. | |
| 5,344,284 | A * | 9/1994 | Delvaux | F01D 11/22 415/173.2 |
| 5,362,202 | A | 11/1994 | Derouet et al. | |
| 5,601,402 | A * | 2/1997 | Wakeman | F01D 11/22 415/173.1 |
| 8,240,986 | B1 | 8/2012 | Ebert | |
| 8,296,037 | B2 * | 10/2012 | Plunkett | F01D 11/20 60/782 |
| 8,534,996 | B1 | 9/2013 | Pankey et al. | |
| 2008/0131270 | A1 | 6/2008 | Paprotna et al. | |
| 2009/0297330 | A1 | 12/2009 | Razzell et al. | |
| 2010/0313404 | A1 | 12/2010 | Bates | |
| 2012/0156007 | A1 | 6/2012 | Bacic | |
| 2013/0209240 | A1 | 8/2013 | McCaffrey | |

* cited by examiner

GAS TURBINE ENGINE RAMPED RAPID RESPONSE CLEARANCE CONTROL SYSTEM

CROSS-REFERENCE TO RELATED APPLICATION

This application claims priority to PCT Patent Application No. PCT/US14/49390 filed Aug. 1, 2014, which claims priority to U.S. Patent Application No. 61/887,002 filed Oct. 4, 2013, which are hereby incorporated herein by reference in their entireties.

STATEMENT REGARDING FEDERALLY SPONSORED RESEARCH OR DEVELOPMENT

This disclosure was made with Government support under FA8650-09-D-2923 0021 awarded by the United States Air Force. The Government may have certain rights in this disclosure.

BACKGROUND

The present disclosure relates to a gas turbine engine and, more particularly, to a blade tip rapid response active clearance control (RRACC) system therefor.

Gas turbine engines, such as those that power modern commercial and military aircraft, generally include a compressor to pressurize an airflow, a combustor to burn a hydrocarbon fuel in the presence of the pressurized air, and a turbine to extract energy from the resultant combustion gases. The compressor and turbine sections include rotatable blade and stationary vane arrays. Within an engine case structure, the radial outermost tips of each blade array are positioned in close proximity to a shroud assembly. Blade Outer Air Seals (BOAS) supported by the shroud assembly are located adjacent to the blade tips such that a radial tip clearance is defined therebetween.

When in operation, the thermal environment in the engine varies and may cause thermal expansion and contraction such that the radial tip clearance varies. The radial tip clearance is typically designed so that the blade tips do not rub against the Blade Outer Air Seal (BOAS) under high power operations when the blade disk and blades expand as a result of thermal expansion and centrifugal loads. When engine power is reduced, the radial tip clearance increases. The leakage of core air between the turbine blade tips and the BOAS may have a negative effect on engine performance/efficiency, fuel burn, and component life.

Minimization of this radial tip clearance may be relatively complex in a military application due to multiple and rapid throttle excursions such as a sudden/snap reaccelerate or hot reburst results in a relatively significant closedown of the radial tip clearance. Conversely, the close down is much less in a steady state condition at which the engine spends the vast majority of its serviceable life. Due to the closedowns associated with such sudden throttle excursions, the turbine is designed to operate with a relatively large tip clearance at the high-time steady state conditions, which thereby affects overall engine performance.

SUMMARY

An active clearance control system of a gas turbine engine, according to one disclosed non-limiting embodiment of the present disclosure, includes a multiple of blade outer air seal assemblies. The active clearance control system also includes a multiple of rotary ramps. Each of the multiple of rotary ramps is associated with one of the multiple of blade outer air seal assemblies.

In a further embodiment of the present disclosure, each of the rotary ramps includes a ramp surface with a ramp low portion, a ramp high portion and a ramp intermediate portion therebetween.

In a further embodiment of any of the foregoing embodiments of the present disclosure, the ramp low portion, the ramp high portion and the ramp intermediate portion are continuous.

In a further embodiment of any of the foregoing embodiments of the present disclosure, a discontinuity is included between the ramp low portion and the ramp high portion.

In a further embodiment of any of the foregoing embodiments of the present disclosure, a barrier is included adjacent to the discontinuity.

In a further embodiment of any of the foregoing embodiments of the present disclosure, the ramp low portion, the ramp high portion and the ramp intermediate portion are circularly arranged.

In a further embodiment of any of the foregoing embodiments of the present disclosure, each of the multiple of blade outer air seal assemblies includes a blade outer air seal and a follower rod that extends therefrom.

In a further embodiment of any of the foregoing embodiments of the present disclosure, each of the multiple of follower rods terminates in a follower transverse to the follower rod.

In a further embodiment of any of the foregoing embodiments of the present disclosure, each of the followers supports an insert. The insert rides upon the respective rotary ramp.

In a further embodiment of any of the foregoing embodiments of the present disclosure, the insert is manufactured of a material different than the follower.

In a further embodiment of any of the foregoing embodiments of the present disclosure, each of the followers supports the insert through a dovetail interface.

In a further embodiment of any of the foregoing embodiments of the present disclosure, each of the multiple of rotary ramps is rotated by a sync ring.

In a further embodiment of any of the foregoing embodiments of the present disclosure, a gear system is included between each of the multiple of rotary ramps and the sync ring.

In a further embodiment of any of the foregoing embodiments of the present disclosure, a rack gear is included on the sync ring and an associated pinion gear mounted to each of the multiple of rotary ramps. Each rack gear interfaces with a respective pinion gear at a gear mesh.

In a further embodiment of any of the foregoing embodiments of the present disclosure, thermal growth of the sync ring is accommodated with the gear mesh.

In a further embodiment of any of the foregoing embodiments of the present disclosure, a slotted linkage is included between each of the multiple of rotary ramps and the sync ring.

A method of active blade tip clearance control for a gas turbine engine, according to another disclosed non-limiting embodiment of the present disclosure, includes rotating a multiple of rotary ramps to control a continuously adjustable radial position for each of a respective multiple of blade outer air seal assemblies.

In a further embodiment of any of the foregoing embodiments of the present disclosure, the method includes rotating each of the multiple of rotary ramps with a sync ring through a respective gear system.

In a further embodiment of any of the foregoing embodiments of the present disclosure, the method includes rotating each of the multiple of rotary ramps with a sync ring through a respective slotted linkage.

In a further embodiment of any of the foregoing embodiments of the present disclosure, the method includes selecting an insert for each of the multiple of the blade outer air seal assemblies to zero out a tolerance within each of the multiple of blade outer air seal assemblies.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
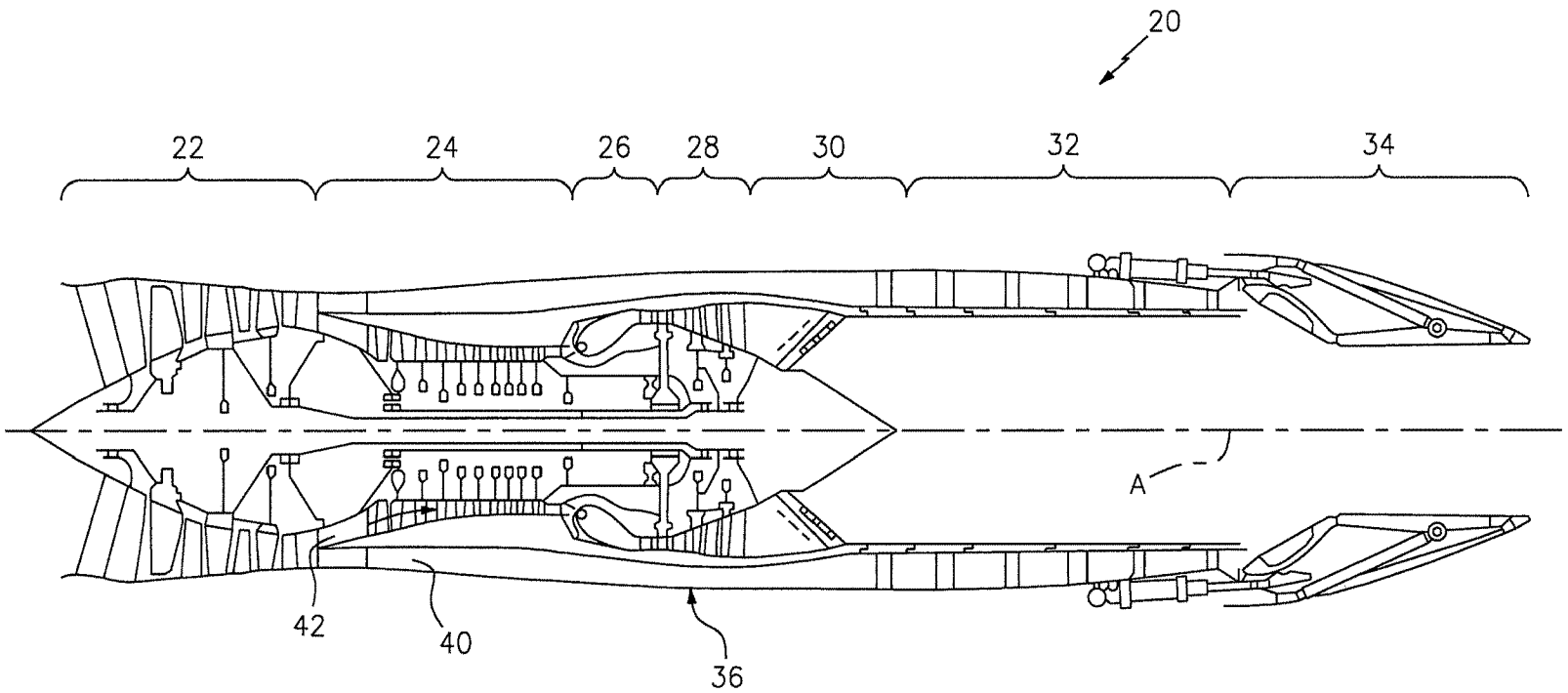
FIG. 1 is a schematic cross-section of one example aero gas turbine engine.

FIG. 1 schematically illustrates a gas turbine engine 20. The gas turbine engine 20 is disclosed herein as a two-spool low-bypass augmented turbofan that generally incorporates a fan section 22, a compressor section 24, a combustor section 26, a turbine section 28, an augmenter section 30, an exhaust duct section 32, and a nozzle system 34 along a central longitudinal engine axis A. Although depicted as an augmented low bypass turbofan in the disclosed non-limiting embodiment, it should be understood that the concepts described herein are applicable to other gas turbine engines including non-augmented engines, geared architecture engines, direct drive turbofans, turbojet, turboshaft, multi-stream variable cycle adaptive engines and other engine architectures. Variable cycle gas turbine engines power aircraft over a range of operating conditions and essentially alters a bypass ratio during flight to achieve countervailing objectives such as high specific thrust for high-energy maneuvers yet optimizes fuel efficiency for cruise and loiter operational modes.

An engine case structure 36 defines a generally annular secondary airflow path 40 around a core airflow path 42. Various static structures and modules may define the engine case structure 36 that essentially defines an exoskeleton to support the rotational hardware.

Air that enters the fan section 22 is divided between a core airflow through the core airflow path 42 and a secondary airflow through a secondary airflow path 40. The core airflow passes through the combustor section 26, the turbine section 28, then the augmentor section 30 where fuel may be selectively injected and burned to generate additional thrust through the nozzle system 34. It should be appreciated that additional airflow streams such as third stream airflow typical of variable cycle engine architectures may additionally be sourced from the fan section 22.

The secondary airflow may be utilized for a multiple of purposes to include, for example, cooling and pressurization. The secondary airflow as defined herein may be any airflow different from the core airflow. The secondary airflow may ultimately be at least partially injected into the core airflow path 42 adjacent to the exhaust duct section 32 and the nozzle system 34.

The exhaust duct section 32 may be circular in cross-section as typical of an axisymmetric augmented low bypass turbofan or may be non-axisymmetric in cross-section to include, but not be limited to, a serpentine shape to block direct view to the turbine section 28. In addition to the various cross-sections and the various longitudinal shapes, the exhaust duct section 32 may terminate in a Convergent/Divergent (C/D) nozzle system, a non-axisymmetric two-dimensional (2D) C/D vectorable nozzle system, a flattened slot nozzle of high aspect ratio or other nozzle arrangement.

Figure 2:
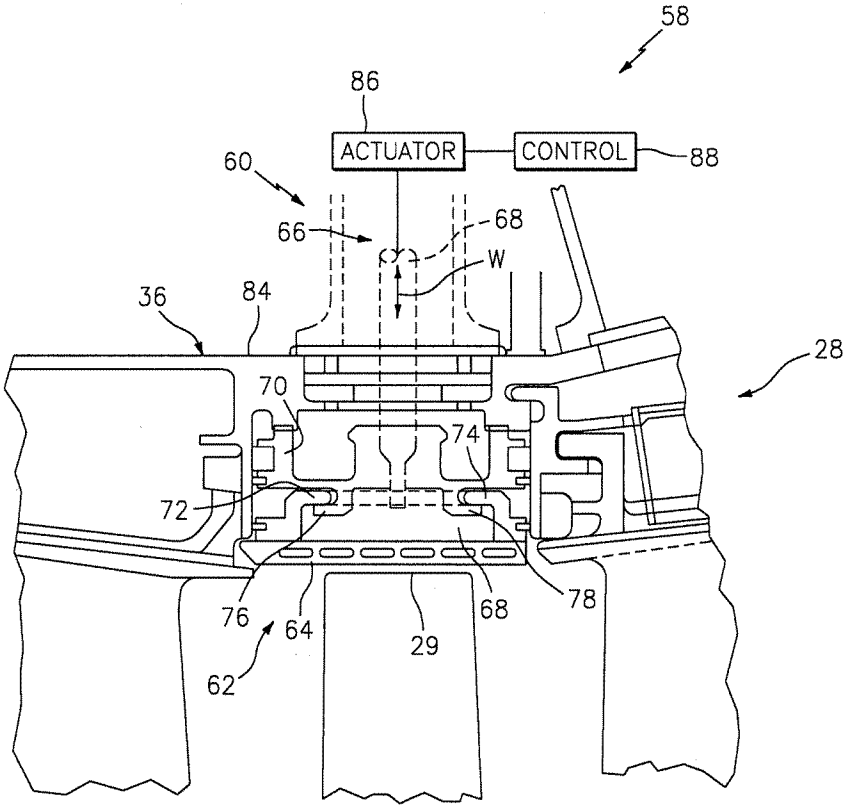
FIG. 2 is an enlarged partial sectional schematic view of a portion of a rapid response active clearance control system according to one disclosed non-limiting embodiment.

With reference to FIG. 2, a blade tip rapid response active clearance control (RRACC) system 58 includes a radially adjustable Blade Outer Air Seal (BOAS) system 60 that operates to control blade tip clearances inside for example, the turbine section 28, however, other sections such as the compressor section 24 may also benefit herefrom. The BOAS system 60 may be arranged around each or particular stages within the gas turbine engine 20. That is, each rotor stage may have an independent radially adjustable BOAS system 60 of the RRACC system 58.

Each BOAS system 60 is subdivided into a multiple of circumferential BOAS assemblies 62, each of which generally includes a respective BOAS 64, a follower rod 68 and a BOAS carrier segment 70. Each BOAS 64 may be manufactured of an abradable material to accommodate potential interaction with the rotating blade tips 29 and may include numerous cooling air passages to permit secondary airflow therethrough. In one disclosed non-limiting embodiment, each BOAS assembly 62 may extend circumferentially for about nine (9) degrees. It should be appreciated that any number of circumferential BOAS assemblies 62 and various other components may alternatively or additionally be provided.

The BOAS carrier segment 70 that is mounted to, or forms a portion of, the engine case structure 36 may at least partially independently support each of the multiple of BOASs 64. That is, each BOAS carrier segment 70 may have a guide feature that interfaces with the case structure 36 to minimize or prevent tipping. It should be appreciated that various static structures and guide features may additionally or alternatively be provided to at least partially support each BOAS assembly 62 yet permit relative radial movement thereof.

A radially extending forward hook 72 and an aft hook 74 of each BOAS 64 respectively cooperates with a forward hook 76 and an aft hook 78 of the full-hoop BOAS carrier segment 70. The forward hook 76 and the aft hook 78 of the BOAS carrier segment 70 may be segmented or otherwise configured for assembly of the respective BOAS 64 thereto. The forward hook 72 may extend axially aft and the aft hook 74 may extend axially forward (shown); vice-versa, or both may extend axially forward or aft within the engine to engage the reciprocally directed forward hook 76 and aft hook 78 of the BOAS carrier segment 70.

With continued reference to FIG. 2, the follower rod 68 radially positions each BOAS assembly 62 along axis W. The follower rod 68 need only "pull" each associated BOAS 64 either directly or through the respective BOAS carrier segment 70 as a differential pressure between the core airflow and the secondary airflow biases the BOAS 64 toward the extended position. For example, the differential pressure may exert an about 1000 pound (4448 newtons) inward force on each BOAS 64.

The follower rod 68 from each associated BOAS 64 may extend from, or be a portion of, an actuator system 86 (illustrated schematically) that operates in response to a control 88 (illustrated schematically) to adjust the BOAS system 60. It should be appreciated that various other components such as sensors, seals and other components may be additionally utilized herewith.

The control 88 generally includes a control module that executes radial tip clearance control logic to thereby control the radial tip clearance relative the rotating blade tips 29. The control module typically includes a processor, a memory, and an interface. The processor may be any type of microprocessor having desired performance characteristics. The memory may be any computer readable medium which stores data and control algorithms such as the logic described herein. The interface facilitates communication with other components and systems. In one example, the control module may be a portion of a flight control computer, a portion of a Full Authority Digital Engine Control (FADEC), a stand-alone unit or other system.

Figure 3:
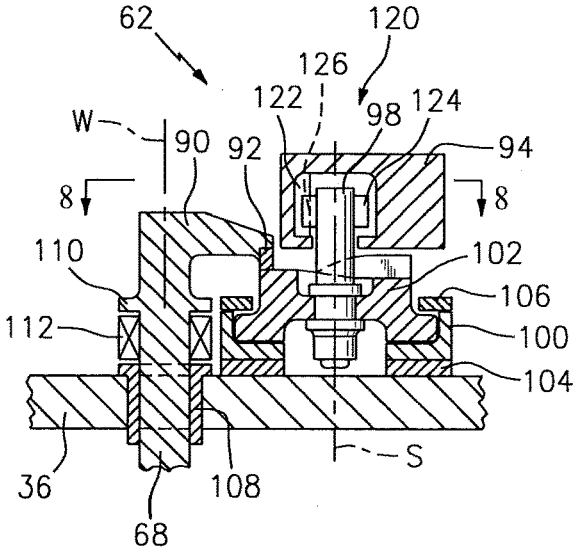
FIG. 3 is a cross-sectional view of the blade tip rapid response active clearance control (RRACC) system.

With reference to FIG. 3, the actuator system 86 generally includes a follower 90 that extends from each follower rod 68, an insert 92, a sync ring 94, a multiple of sync ring guides 96 (FIG. 5), a spindle 98, a rotary ramp support 100, a rotary ramp 102, a ramp spacer insert 104 and a retainer plate 106. It should be appreciated that additional or alternative components may be provided and that although a single circumferential BOAS assembly 62 is described and illustrated in detail, it should be appreciated that each BOAS 64 is moved by one associated BOAS assembly 62 around the sync ring 94.

Each follower rod 68 extends through a bushing 108 along axis W in the engine case structure 36. The follower rod 68 may include a shoulder 110 that traps a bias member 112 such as a spring between the bushing 108 and the shoulder 110. The bias member 112 provides a radially outward bias to the follower rod 68 when the RRACC system 58 is idle such as when the engine 20 is shut down. That is, the bias member 112 maintains tautness to the actuator system 86.

Figure 4:
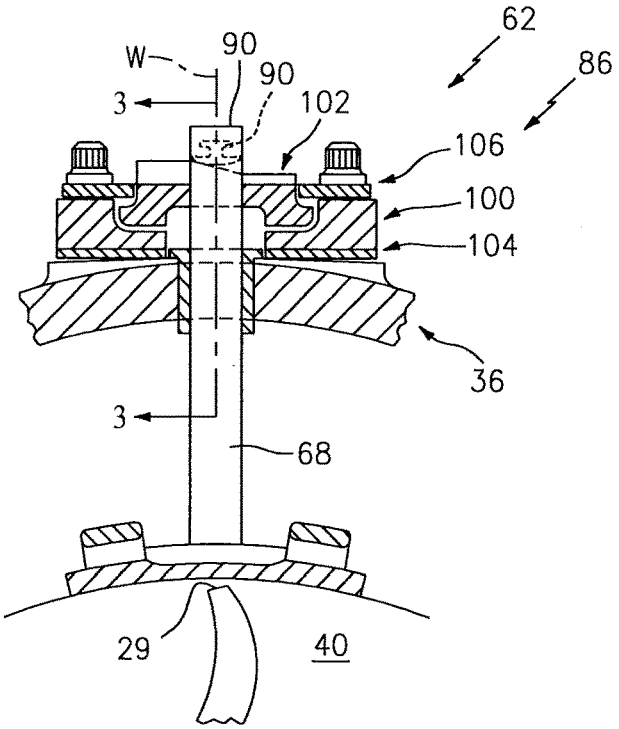
FIG. 4 is al lateral sectional view of the blade tip rapid response active clearance control (RRACC) system.

The follower 90 extends axially from the radially arranged follower rod 68 to support the insert 92 that rides upon the rotary ramp 102 (FIG. 4). That is, the follower 90 is transverse to the follower rod 68.

Figure 6:
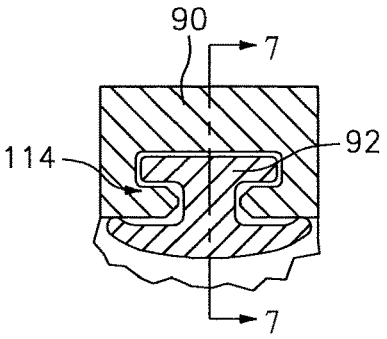
FIG. 6 is a lateral sectional view of a follower and an insert therefor according to one disclosed non-limiting embodiment.
Figure 7:
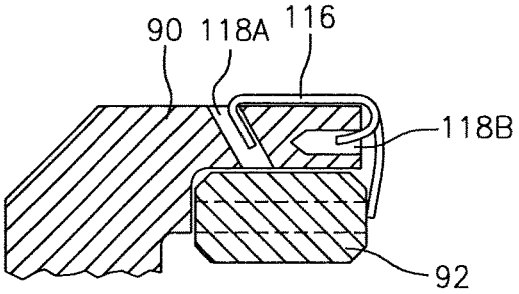
FIG. 7 is a cross-sectional view of the follower and an insert therefor retained by a clip.

In one disclosed non-limiting embodiment, the follower 90 and the insert 92 define a dovetail interface 114 (FIG. 6) therebetween to facilitate replacement of the insert 92. The insert 92 provides effective radial and tangential load transmission from the rotary ramp 102 to the follower 90 and permits the insert 92 to be manufactured of a material different than the follower 90. In one example, the insert 92 may be manufactured of a high cobalt material to facilitate wear resistance. The insert 92 may be retained with a clip 116 engageable with a first slot 118A and a second slot 118B in the follower 90 (FIG. 7).

The radial position of the BOAS assembly 62 may differ from one BOAS 64 location to the next due to, for example, the stack-up tolerance of the numerous components and interfaces. The insert 92 thereby provides a single component replacement to optimize the radial position of each BOAS 64. That is, the insert may be specifically selected to adjust each circumferential BOAS assembly 62 to, for example, zero out specific tolerances in each BOAS assembly 62. In other words, one BOAS assembly 62 may include a relatively thick insert 92 while another BOAS assembly 62 may include a relatively thin insert 92 to accommodate different tolerances in each. Such adjustability through inset 92 replacement permits the usage of individually ground BOASs 64 to minimize—if not eliminate—the heretofore requirement of an assembly grind. The individually ground BOASs 64 are also typically interchangeable one for another which simplifies engine maintenance. In another disclosed non-limiting embodiment, the ramp spacer insert 104 additionally or alternatively provides a similar function.

The process of adjusting the radial position of each BOAS 64 at engine assembly may include, for example, a fixture that locates on the case structure 36 and provides an engine-concentric cylindrical surface inboard of the BOASs 64 of the BOAS system 60; a single compression ring to push all followers 90 radially inboard into the sync ring 94; measurement of the gap/clearance between each BOASs 64 and the fixture; and measurement of the insert 92 used at each BOAS location and replacement with an insert 92 having a measured radial thickness that achieves the optimal radial position of each BOASs 64. It should be appreciated that other processes may also be utilized.

Figure 8:
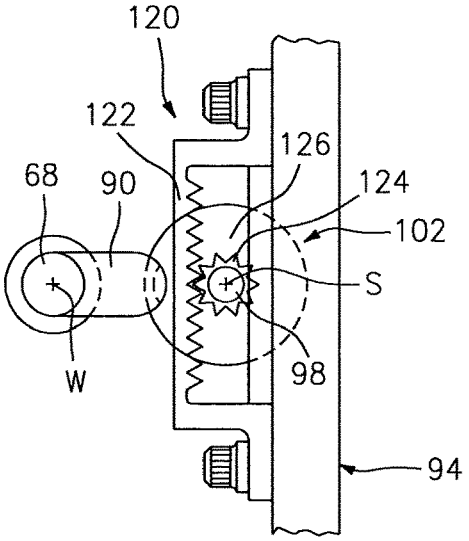
FIG. 8 is an outside looking in view of a gear system of the sync ring taken along line 8-8 in FIG. 3 according to one disclosed non-limiting embodiment.

With continued reference to FIG. 3, the sync ring 94 is axially captured by the multiple of sync ring guides 96 (FIG. 5) such that rotation of the sync ring 94 drives each spindle 98 of each BOAS assembly 62 through a respective gear system 120 (FIG. 8). Each of the multiple of sync ring guides 96 may include a bias member 97 such as a spring to at least partially elastically support the sync ring 94 relative to the case 36.

Each gear system 120 includes a rack gear 122 that interfaces with a pinion gear 124 on the spindle 98. Rotation of the sync ring 94 thereby rotates each rotary ramp 102 through the gear mesh 126 between the rack gear 122 and pinion gear 124. The sync ring 94 may be of a full hoop configuration in which thermal growth is accommodated through the gear mesh 126. That is, as the sync ring 94 grows radially inward and outward in diameter under engine operation, the displacement thereof is decoupled through radial movement of the pinion gear 124—parallel to an axis S of the spindle 98—along the rack gear 122.

Figure 9:
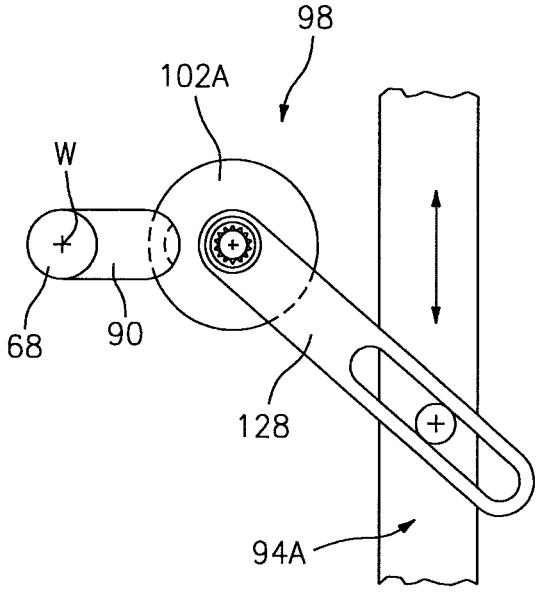
FIG. 9 is an outside looking in view of a linkage system of the sync ring according to another disclosed non-limiting embodiment.
Figure 10:
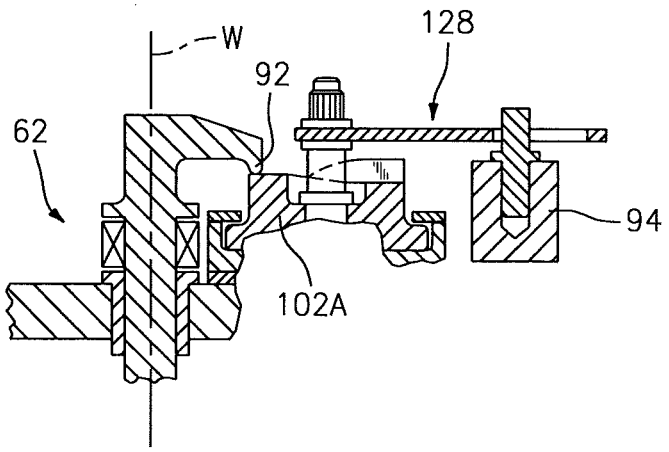
FIG. 10 is a cross-sectional view of the linkage system of FIG. 9.

In another disclosed non-limiting embodiment, a slotted linkage 128 interconnects the sync ring 94 with the rotary ramp 102A (FIG. 9). That is, the thermal growth of the sync ring 94A is decoupled from the rotary ramp 102 through the slotted linkage 128 (FIG. 10).

Figure 5:
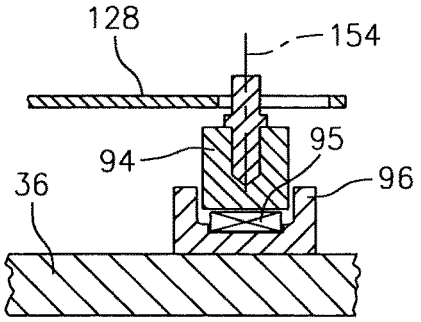
FIG. 5 is an axial sectional view of a sync ring retainer.

With reference to FIG. 5, the sync ring guides 96 retain and guide the sync ring 94 in the axial direction. A bias member 95 such as a spring loads the sync ring 94 in the radial direction to maintain the sync ring 94 generally concentric with the engine centerline A, yet allows the sync ring 94 to grow outward and inward with respect to the case structure 36. It should be appreciated that the sync ring 94 need not maintain precise concentricity with the case structure 36, because the respective gear system 120 (FIG. 8) in one disclosed non-limiting embodiment or the slotted linkage 128 (FIG. 9) in another, accommodates the relative radial movement therebetween.

Figure 11:
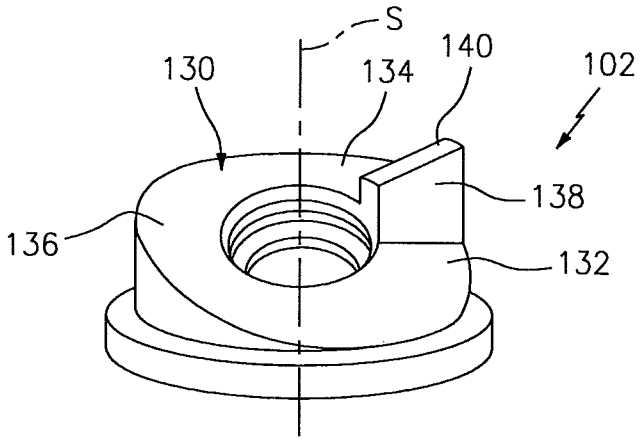
FIG. 11 is a perspective view of a rotary ramp according to one disclosed non-limiting embodiment.

With reference to FIG. 11, the rotary ramp 102 includes a ramp surface 130 upon which the insert 92 rides as the rotary ramp 102 is rotated about the spindle axis S. The rotary ramp 102 defines an essentially infinitely adjustable radial position for the respective BOAS 64 of each BOAS assembly 62 between the radially innermost position for the respective BOAS 64 and the radially outermost position for the respective BOAS 64.

A ramp low portion 132 of the ramp surface 130 defines a radially innermost position for the respective BOAS 64 while a ramp high portion 134 of the ramp surface 130 defines a radially outermost position for the respective BOAS 64. The ramp low portion 132 may be used for a partial power operational condition; while the ramp high portion 134 may be used for a snap transient operational condition e.g., military-idle-military-power. The ramp intermediate portion 136 therebetween may be used for various cruise power operational conditions. That is, the ramp surface 130 extends in a circular ramp of almost three hundred and sixty degrees to provide an essentially infinitely adjustable radial BOAS 64 position between the circularly adjacent ramp low portion 132 and the ramp high portion 134.

A discontinuity 138 or step is located between the circularly adjacent ramp low portion 132 and the ramp high portion 134 over which the insert 92 does not cross. In other words, the inset 92 rides around the ramp surface between the ramp low portion 132 and the ramp high portion 134 along the ramp intermediate portion 136 without crossing the discontinuity 138. A barrier 140 may be further provided at the discontinuity 138 to provide a mechanical stop to prevent passage of the insert 92.

Figure 12:
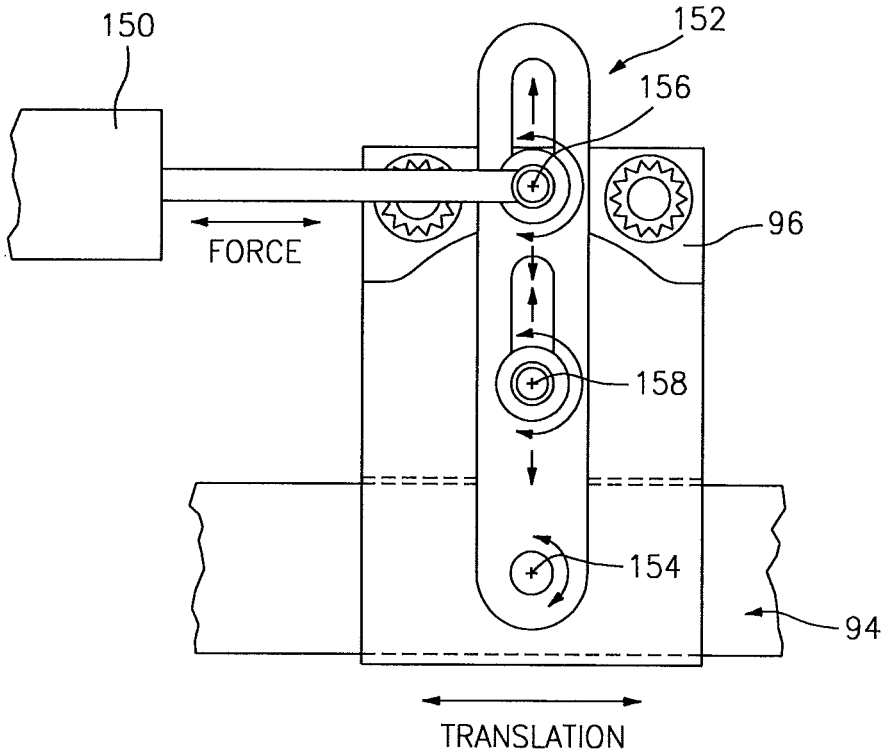
FIG. 12 is schematic view of an actuator linkage for the sync ring.

With reference to FIG. 12, at least one actuator 150 which may be a mechanical, hydraulic, electrical and/or pneumatic drive operates to rotate the sync ring 94 through a linkage 152. Radial loads on the BOAS 64 cause each respective insert 92 to be loaded against the rotary ramp 102 such that as the sync ring 94 is rotated, the follower 90, and thus the BOAS 64, are radially positioned. That is, the actuator 150 provides the motive force to rotate the sync ring 94 and thereby extend and retract the radially adjustable BOAS system 60.

The linkage 152 generally includes a pivot interface 154 at the sync ring 94, a slotted actuator interface 156 and a slotted intermediate interface 158 therebetween. Although the slotted actuator interface 156 and the slotted intermediate interface 158 are illustrated in the disclosed non-limiting embodiment, it should be appreciated that any two of the three interfaces 154, 156, 158 may be slotted to provide the desired degrees of freedom.

In this disclosed non-limiting embodiment, the actuator 150 drives the linkage 152 to pull the sync ring 94 in a rotational direction around the engine centerline A from the ramp low portion 132 toward the ramp high portion 134. Further, the length or position of the actuator 150 may be biased such that the follower 90 is positioned in the ramp high portion 134 to provide a fail-safe outward position for the BOAS system 60 should the intended force of the actuator 150 not be attained.

The RRACC system 58 enables turbine blade tip clearance to be reduced significantly at cruise as well as other engine conditions through precise radial positioning of each BOAS 64 at assembly and enables rapid variable radial adjustment of the BOAS system 60 during operation/flight. The position of each individual BOAS 64 is readily independently adjusted by fitting of a specific insert 92 to compensate for non-symmetrical, out-of-round, and sinusoidal rub patterns demonstrated during engine development to provide an efficiency improvement relative to simple offset/non-concentric grind and assembly grind methods. The individual adjustability provided by the insert 92 further enables tighter control of BOAS substrate and/or coating rub depth, substrate and/or coating thickness to, for example, provide improved BOAS durability life and/or improved turbine performance with reduced cooling flow. The insert 92 further enables peak tip clearance performance to be restored in the field regardless of how many/few BOAS 64 are replaced for reasons such as erosion. This achieves greater performance than what is typically achievable with an assembly grind and lowers maintenance cost.

Whereas the RRACC system 58 operates to retract the BOAS away from the blade tip during sudden throttle excursions, tip clearances are significantly reduced and performance significantly improved at high-time steady state conditions. The RRACC system 58 also improves and optimizes the cold assembly flowpath position of each BOAS by compensating for part tolerance stack-ups and in-flight thermal/mechanical effects.

The use of the terms "a" and "an" and "the" and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to the normal operational attitude of the vehicle and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

The foregoing description is exemplary rather than defined by the features within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. An active clearance control system of a gas turbine engine, the system comprising:

a multiple of blade outer air seal assemblies; and a multiple of rotary ramps, each of the multiple of rotary ramps associated with one of the multiple of blade outer air seal assemblies;

each of the multiple of blade outer air seal assemblies including a blade outer air seal and a follower rod that extends from the blade outer air seal;

each of the multiple of follower rods terminating in a follower transverse to the follower rod;

each of the followers supporting an insert that rides upon the respective rotary ramp; and each of the followers supporting the insert through a dovetail interface.

2. The system as recited in claim 1, wherein each of the rotary ramps includes a ramp surface with a ramp low portion, a ramp high portion and a ramp intermediate portion therebetween.

3. The system as recited in claim 2, wherein the ramp low portion, the ramp high portion and the ramp intermediate portion are continuous.

4. The system as recited in claim 2, further comprising a discontinuity between the ramp low portion and the ramp high portion.

5. The system as recited in claim 4, further comprising a barrier adjacent the discontinuity.

6. The system as recited in claim 2, wherein the ramp low portion, the ramp high portion and the ramp intermediate portion are circularly arranged.

7. The system as recited in claim 1, wherein the insert is manufactured of a material different than the follower.

8. The system as recited in claim 1, wherein each of the multiple of rotary ramps are rotated by a sync ring.

9. The system as recited in claim 8, further comprising a gear system between each of the multiple of rotary ramps and the sync ring.

10. The system as recited in claim 8, further comprising a rack gear on the sync ring and an associated pinion gear mounted to each of the multiple of rotary ramps, wherein each rack gear interfaces with a respective pinion gear at a gear mesh.

11. The system as recited in claim 10, wherein thermal growth of the sync ring is accommodated with the gear mesh.

12. The system as recited in claim 8, further comprising a slotted linkage between each of the multiple of rotary ramps and the sync ring.

* * * * *